US007935031B1

(12) United States Patent
Hsiao

(10) Patent No.: US 7,935,031 B1
(45) Date of Patent: May 3, 2011

(54) BABY WALKER

(76) Inventor: Tung Pin Hsiao, Tainan County (TW)

( * ) Notice: Subject to any disclaimer, the term of this patent is extended or adjusted under 35 U.S.C. 154(b) by 0 days.

(21) Appl. No.: 12/656,040

(22) Filed: Jan. 14, 2010

(51) Int. Cl.

| | |
|---|---|
| ***A63B 22/20*** | (2006.01) |
| ***A63B 21/008*** | (2006.01) |
| ***A61H 3/04*** | (2006.01) |
| ***F16D 57/00*** | (2006.01) |
| ***B62B 7/00*** | (2006.01) |

(52) U.S. Cl. ..... 482/68; 482/113; 188/290; 280/87.051

(58) Field of Classification Search ..... 482/66–69, 482/78, 111–113, 131–137, 142; 188/290, 188/292–294; 135/65, 67; 280/87.01, 87.021, 280/87.041, 87.051; 297/5; 472/1, 14; *A63B 21/008, 22/20; A61H 3/04; B62B 7/00; F16D 57/00*

See application file for complete search history.

(56) References Cited

U.S. PATENT DOCUMENTS

| | | | | |
|---|---|---|---|---|
| 923,556 | A * | 6/1909 | Miller | 482/68 |
| 2,725,231 | A * | 11/1955 | Hoover | 482/73 |
| 2,833,332 | A * | 5/1958 | Nabors | 297/6 |
| 3,062,548 | A * | 11/1962 | Foster et al. | 473/445 |
| 3,495,824 | A * | 2/1970 | Cuinier | 482/113 |
| 5,110,118 | A * | 5/1992 | Winey | 482/73 |
| 6,494,815 | B1 * | 12/2002 | Welsh, Jr. | 482/68 |

* cited by examiner

*Primary Examiner* — Nicholas D Lucchesi
*Assistant Examiner* — Oren Ginsberg
(74) *Attorney, Agent, or Firm* — Bacon & Thomas, PLLC

(57) ABSTRACT

A baby walker is disclosed, comprising a base, having an adjustable link at each of its two laterals and a plurality of rollers at its bottom; and a surround, having two regulators sustained by the top ends of the adjustable links, where the two regulators are adjusted until a width is reached to accommodate each riding infant child, and some fixing members are used to encircle the child for holding his/her body, which is just like holding by somebody's hands, where the child's weight is fully sustained and his/her body is kept in a balanced gesture, which brings about good sense of security and comfort to the child whenever he/she is learning to walk.

4 Claims, 8 Drawing Sheets

BABY WALKER

BACKGROUND OF THE INVENTION

1. Field of the Invention

This invention relates generally to a baby walker and more particularly to one that is capable of assisting infant children to learn to walk, and features a good sense of security and comfort for the walking.

2. Description of the Prior Art

During the growth of infant children, a baby walker (customarily named: crab carriage) always plays the role of a growth assistant to help babies transit from crawling stage through to walking stage. By means of the baby walker, the child's feet are available to touch the ground. And through the push of the baby walker, an infant child is able to learn to stand up and walk. FIGS. 1 & 2 show the structure of a prior baby walker 1, comprising:

a base 10, hollow in shape, having a plurality of rollers 11 at its bottom, used to roll against the ground, and the base 10 is provided with an upward extended foldable brace 12 at each of the two internal sides facing to each other; and a hollow surround 13, placed fixedly on top of the two foldable braces 12, having a soft seat 14 at the center of its bottom portion where the seat is provided with openings at both laterals to seat a riding infant child, where the child's feet pass through the openings of the seat 14 for stretching downward;

During the use of the baby walker, an infant child is held to tuck in the surround 13 and place on the seat 14, where the child's feet pass through the openings of the seat 14 to touch the ground, and the child is ready to learn to walk in both sitting and standing postures with the support of the baby walker 1; since the physique of the infant child is not yet developed well, the muscles for sustaining the body are susceptible to fatigue for a long sitting which would bring about great discomfort. On the other hand, a long-time learning of using two legs to move during the early stage of infancy would have the infant trunk prematurely suffer entire body weight, which easily leads to the O-typed leg shape. Besides, the prior baby walker 1 is short of breaks at its rollers 11. As an infant child is prompt in moving the baby walker, which surely makes the rollers 11 to roll rapidly. And it means the infant child is easily subject to injury if no breaks.

SUMMARY OF THE INVENTION

In light of the aforesaid drawbacks, this inventor conceived deeply the idea for the research of the invention, and eventually the longtime endeavors gave birth to this invention.

The objective of this invention is to provide a baby walker that is capable of assisting infant children to learn to walk, and features a good sense of security and comfort for the walking.

To achieve the foregoing objectives, the baby walker of this invention comprises: a base, hollow in shape, having an upward extended adjustable link at each of its two laterals, and having a plurality of rollers at its bottom for rolling against the ground; and a hollow surround, having two regulators which are sustained by the top ends of the adjustable links, where the two regulators each has a sliding trough in the side that faces to each other, and one of two adjusting poles is placed in the way that its two ends are joined to the like ends of two sliding troughs respectively, where the distance between the two adjusting poles is adjustable; the two adjusting poles each is worn firmly by a connecting member, and fixing members are extended from both sides of the connecting member, where the fixing members are used to encircle the riding infant child for holding the body.

DETAILED DESCRIPTION OF THE INVENTION

To achieve the foregoing objects of the present invention, the techniques adopted and the achievable function are detailed described with reference to the following preferred exemplified embodiment and the accompanying drawings for a thorough comprehension.

Figure 1:
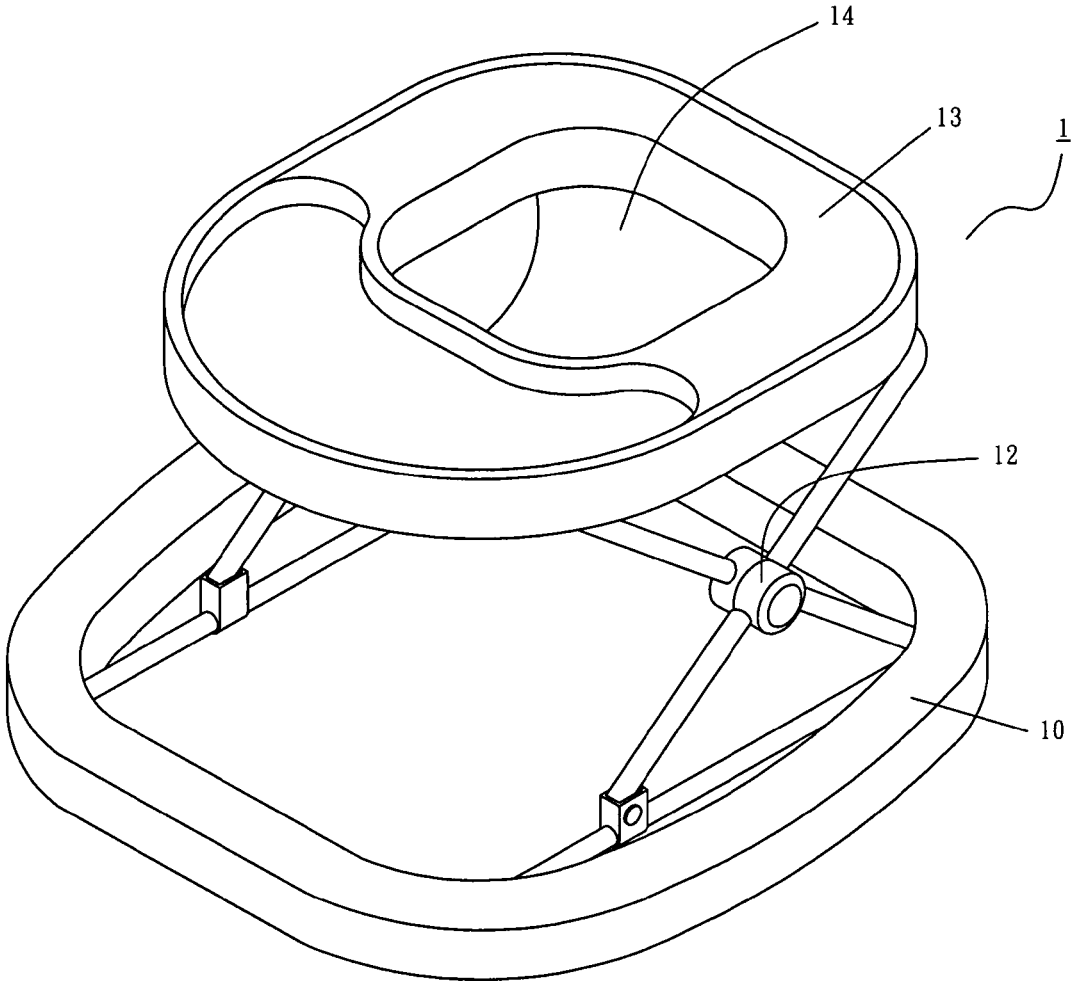
FIG. 1 (PRIOR ART)
FIG. 1 is a three-dimensional view showing the structure of a prior baby walker.
Figure 2:
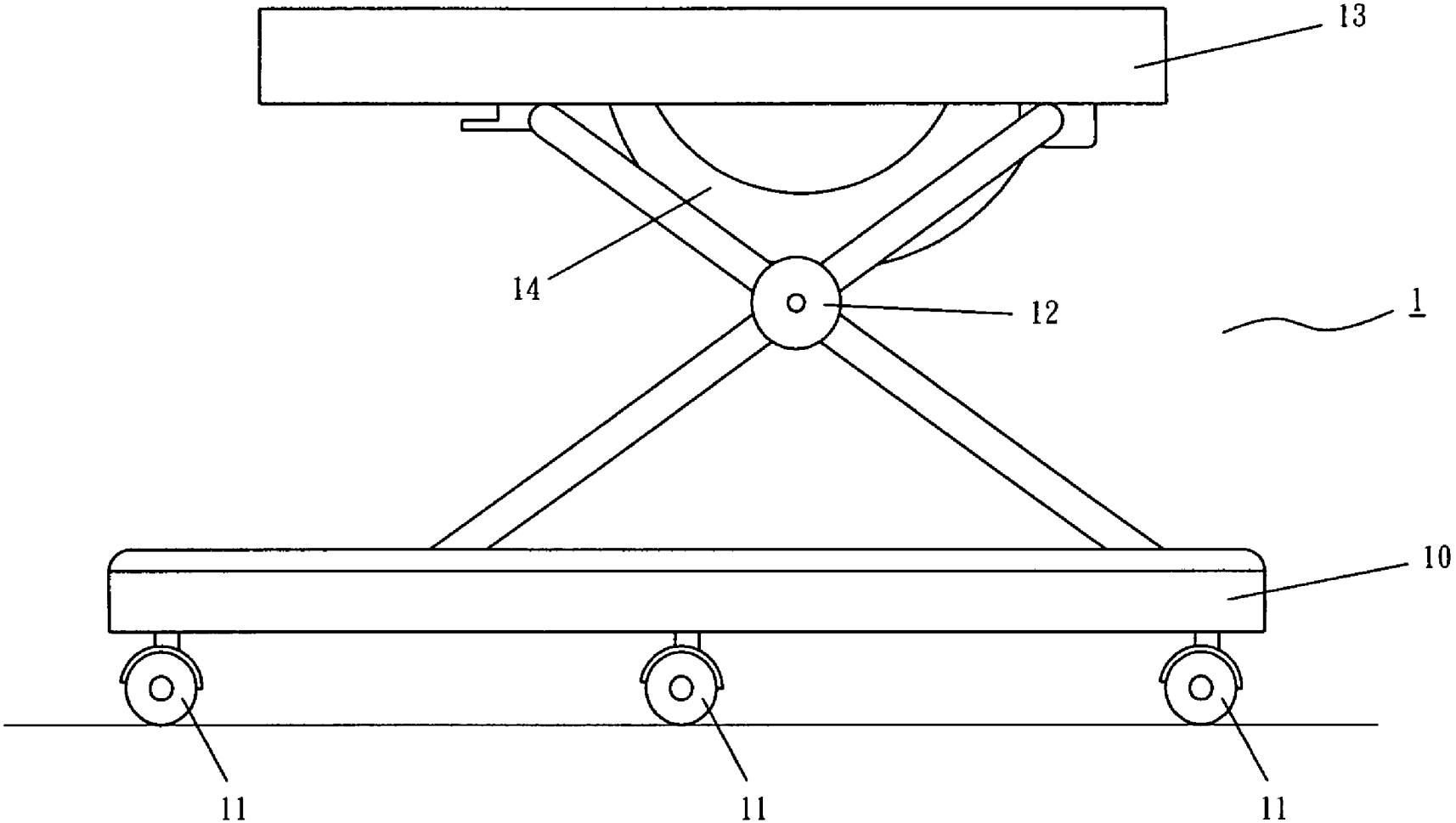
FIG. 2 (PRIOR ART)
FIG. 2 is a side view showing the structure of the prior baby walker.
Figure 3:
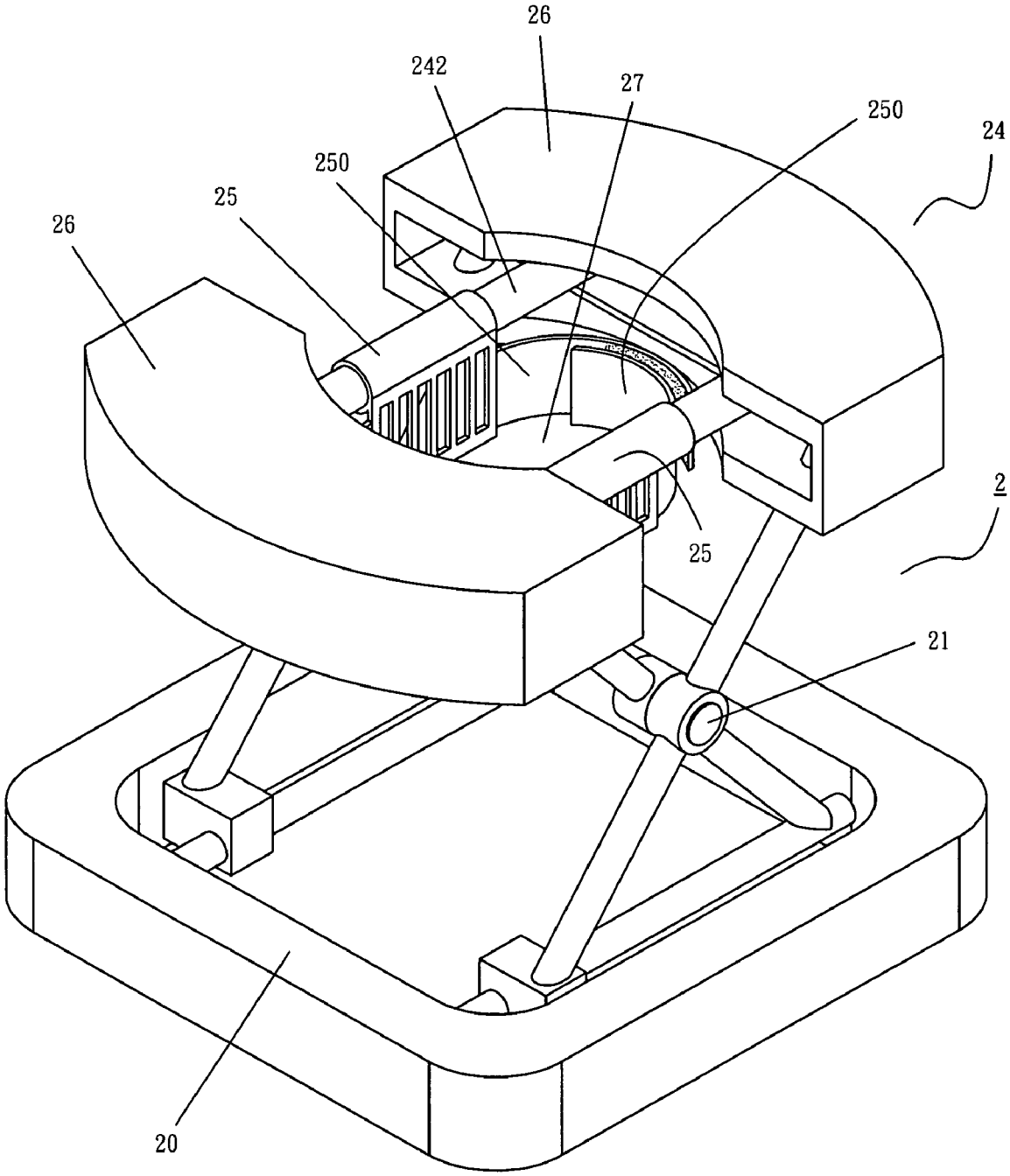
FIG. 3 is a three-dimensional view showing the structure (I) of an exemplary embodiment of this invention.
Figure 4:
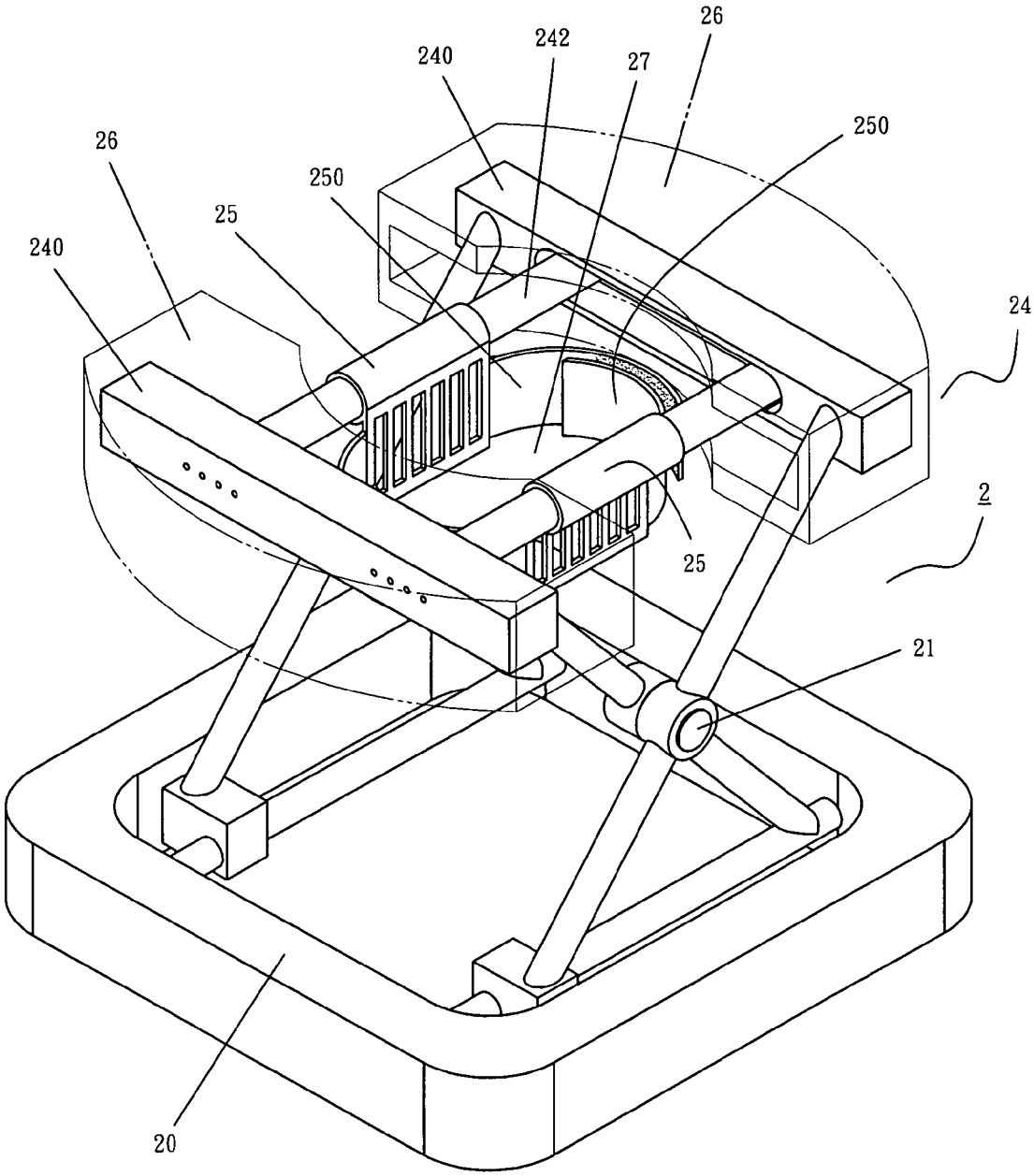
FIG. 4 is a three-dimensional view showing the structure (II) of the exemplary embodiment of this invention.
Figure 5:
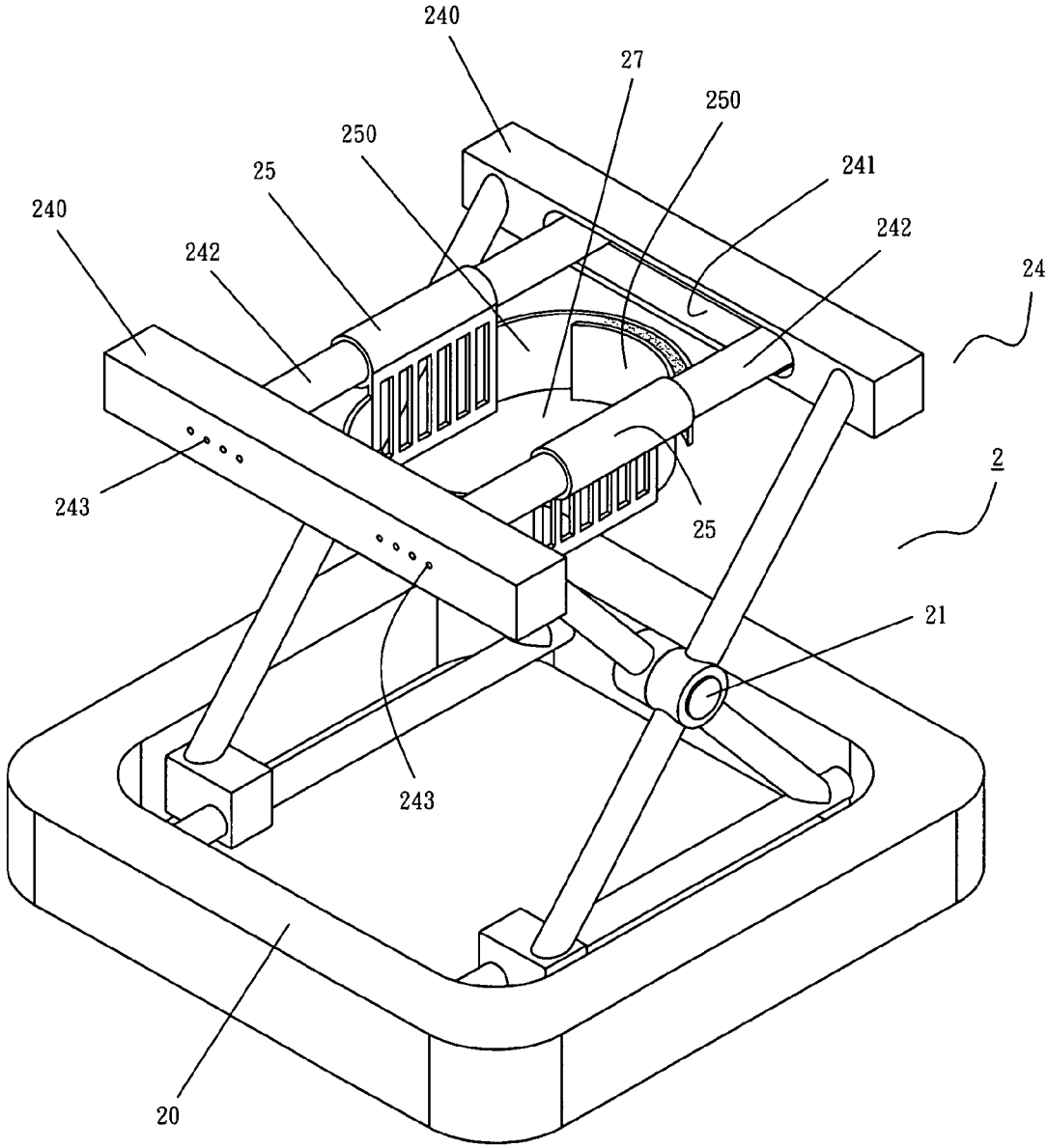
FIG. 5 is a three-dimensional view showing the structure (III) of the exemplary embodiment of this invention.

Referring to FIGS. 3~5, the baby walker 2 of this invention comprises:

a base 20, hollow in shape, having an adjustable link 21 at each of its two laterals, and having a plurality of symmetric rollers at the bottom of the base 20, where the rollers may be damping wheels 22 which are used to roll against the ground. Shown in FIGS. 8 & 9, the damping wheel 22 is provided with a cavity 220 in its internal, where the cavity 220 has an inner gear surface 221 at its inner wall. And the cavity 220 contains an arced flat member 222 and an outer gear 224 which has its partial gear surfaces in mesh with the inner gear surfaces 221. The axle 223 of the outer gear 224 extends through a crank 229 to stretch out through the center of the damping wheel 22. The outer protruded surface of the arced flat member 222 corresponds to the inner gear surface 221 while its inner indented surface corresponds to the outer gear 224. The cavity 220 is infused with oil 23. The cavity 220 of the damping wheel 22 is provided with an inlet 225 and an outlet 226 at its two laterals facing to each other, where the inlet 225 and the outlet 226 are interconnected by a tube 227 outside the cavity 220, which is used for the circulation of the oil 23 in case the oil 23 is compressed as the outer gear 224 rotates around the inner gear surface 221. An oil regulating valve 228 is set up at the outlet 226 for the flow control over the oil 23 flowing into the tube 227. The more flow of the oil 23, the less resistance on the damping wheel 22 from its rotation. Reversely, the less flow of the oil 23, the more resistance on the damping wheel 22, which slows the damping wheel 22, for the modulation of the rotational speed of the damping wheel.

A hollow surround 24, having two regulators 240 sustained by the top ends of the adjustable links 21, where the two regulators 240 each has a sliding trough 241 in the side that faces to each other, and each of two adjusting poles 242 is placed in the way that its two ends are joined to the like ends of the two sliding troughs 241 respectively, where the two sliding poles 242 are available to slide along the sliding troughs 241 to adjust the distance in between. The two adjusting poles 242 each is worn firmly by a connecting member 25, and a fixing member 250 is extended from each of two sides of the connecting member 25 with a sticky buckle (VELCRO) at its end, where the fixing members 250 are used to encircle the riding infant child for holding the body. The regulator 240 is provided with positioning members 243 corresponding to the end portion of the adjusting pole 242, where the adjusting pole 242 is available to be immobilized after one move.

Figure 6:
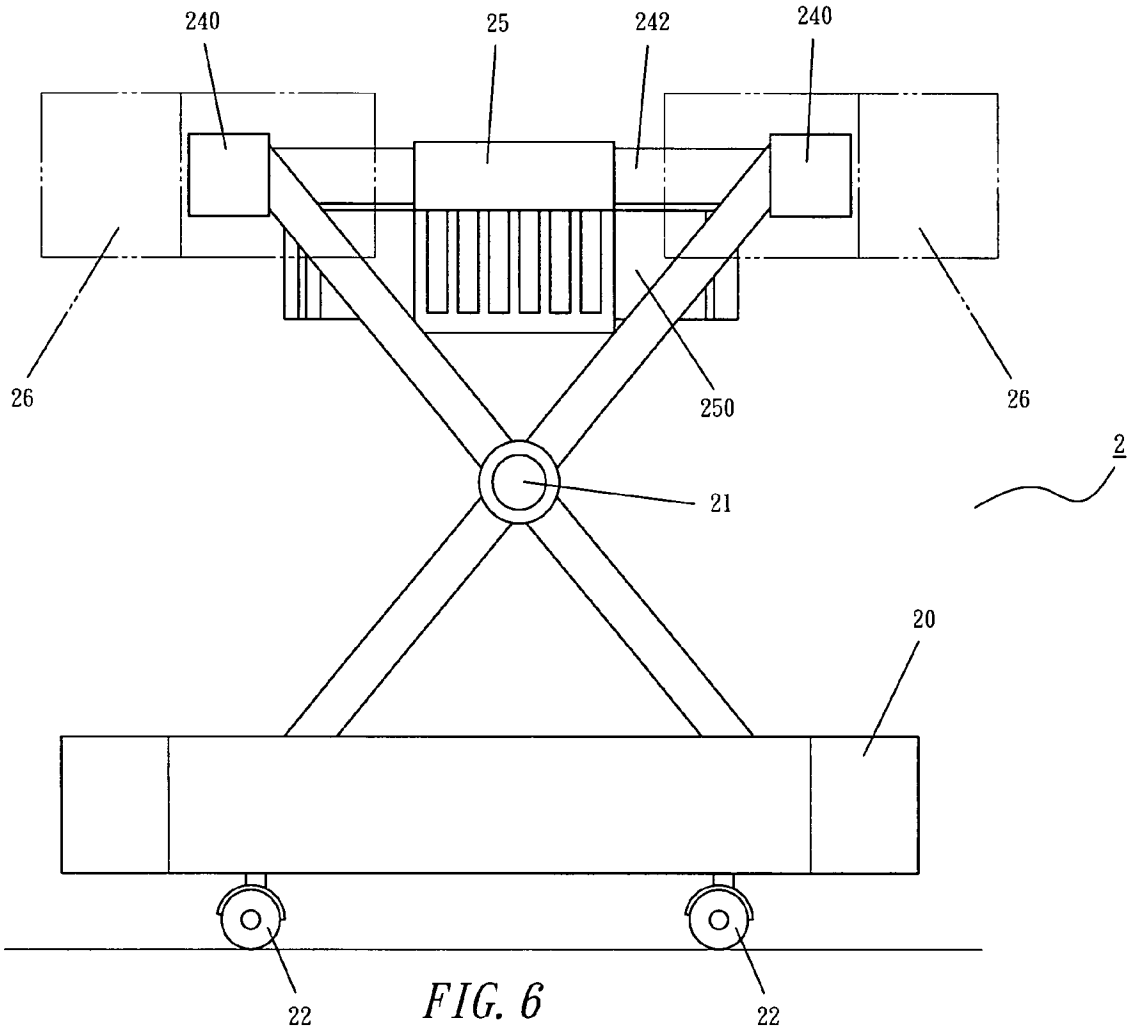
FIG. 6 is a side view showing a partial structure of the exemplary embodiment of this invention.
Figure 7:
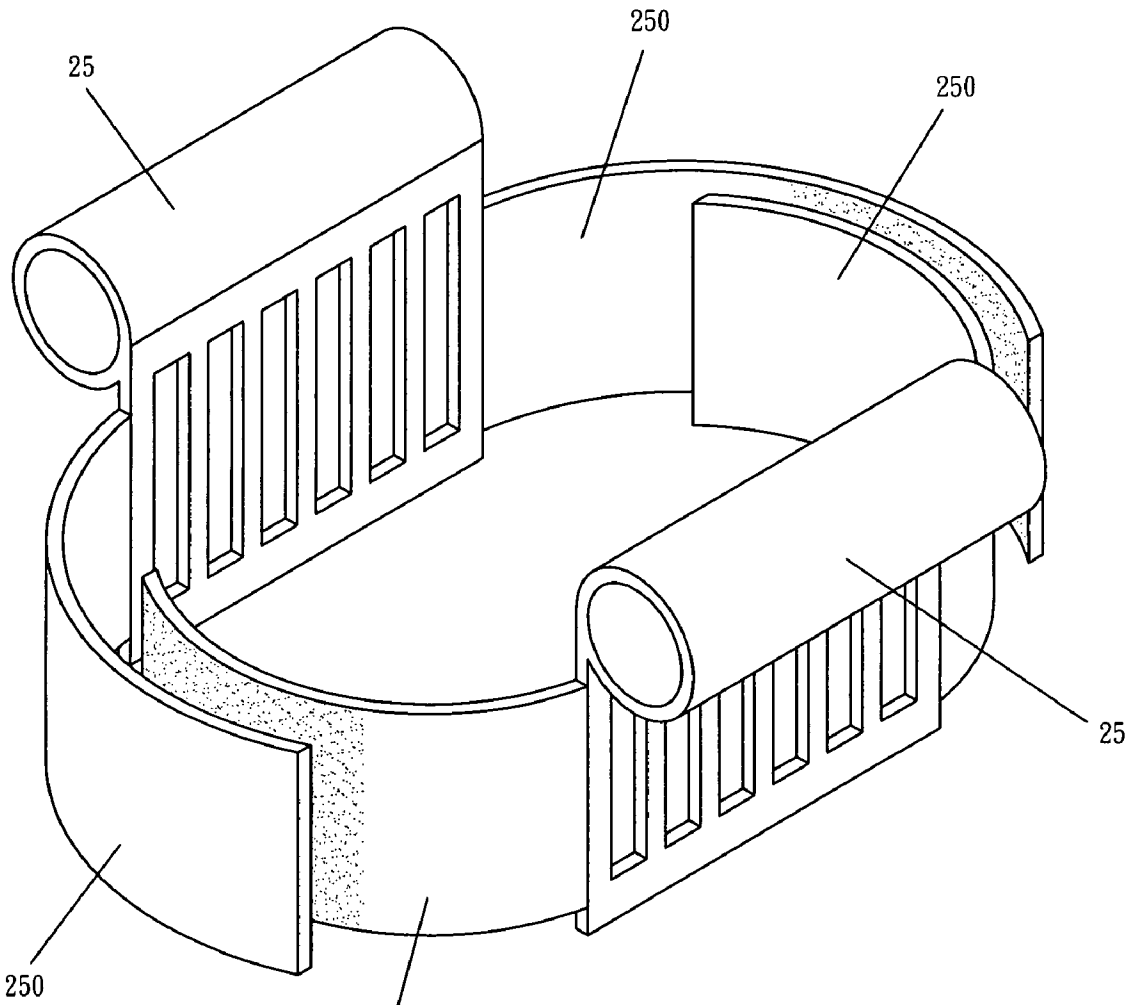
FIG. 7 is a three-dimensional view showing the structure of a fixing member of the exemplary embodiment of this invention.
Figure 8:
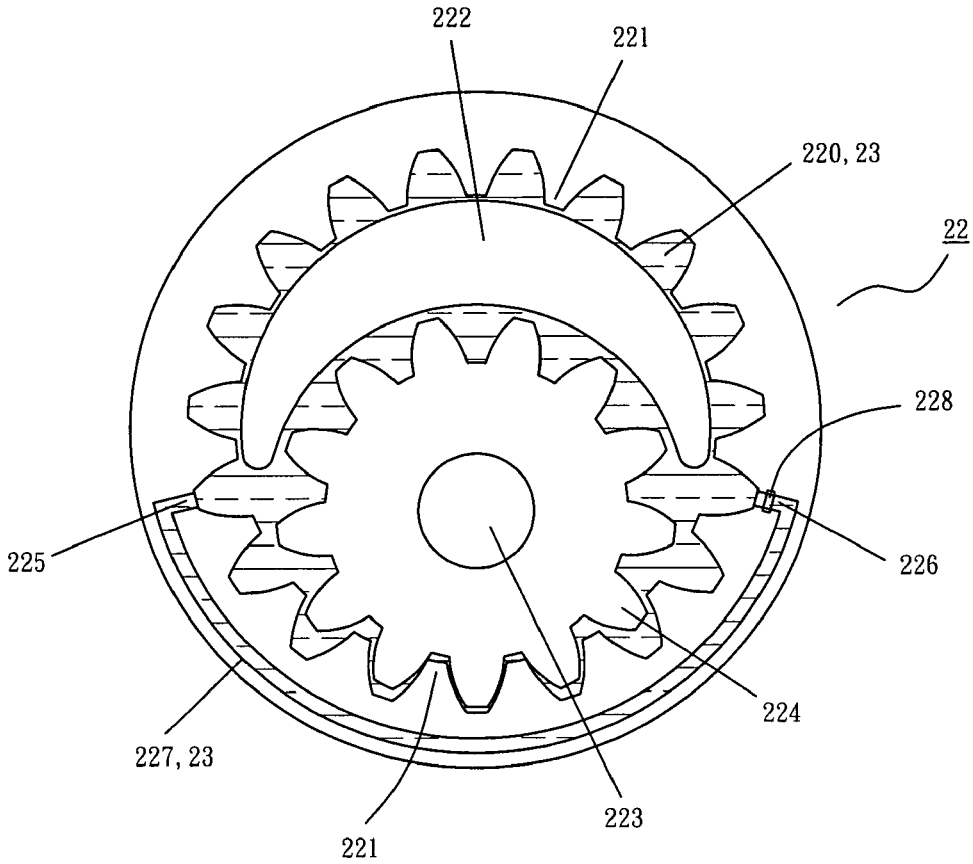
FIG. 8 is a sectional view of a damping wheel of the exemplary embodiment of this invention.
Figure 9:
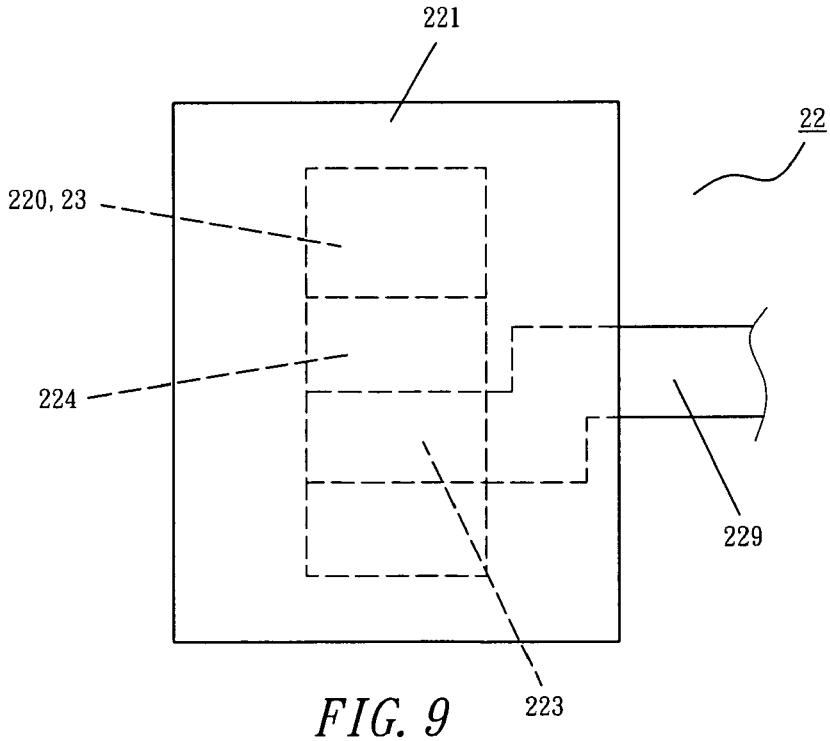
FIG. 9 is a reference diagram of the structure of the damping wheel of the exemplary embodiment of this invention.

And a sheath 26 is used to wrap each regulator 240. Referring to FIGS. 6~8, during the use of the baby walker, an infant child is held to tuck in the hollow 27 of the surround 24, followed by the adjustment of the distance between the two adjusting poles 242 until the width in between the two adjusting poles 242 can accommodate the infant child; meanwhile, the adjusting poles 242 are placed to prop against the infant child's body. Once the distance is adjusted, the positioning members 243 are used to fix the adjusting poles 242, and the fixing members 250 are used to encircle the body of the infant child, where the infant child's body is held by the adjusting poles 242 and the fixing members 250. The infant child is learning to walk with the help of the baby walker 2, where the baby walker 2 is actually driven by the feet of the infant child. The crank 229 connected to the base 20 of the baby walker 2 is activated to drive the damping wheel 22 to rotate. And the parents are available to control the rotational speed of the damping wheel 22 through the adjustment of the regulating valve 228 for the flow control of oil.

Accordingly, this invention has at least the following advantages and functions:

1.) The encirclement of infant child's body by the fixing members 250 is just like holding by somebody's hands, where the child's weight is fully sustained and the body is kept in a balanced gesture, which brings about good sense of security and comfort to the child as he/she is learning to walk.

2.) As the infant child is learning to walk with the help of the baby walker 2, the rotational speed of the damping wheel 22 can be controlled through the adjustment of the regulating valve 228 for the flow control of oil, which substantially prevents the injuries from colliding with nearby objects due to speedy moving of the baby walker driven by the infant child.

In conclusion, the improvement accomplished by the present invention on the baby walker had not appeared in the prior art, which is construed to be a useful, novel, and creative invention, thereby filing the present application herein subject to the patent law, which may obtain a patent thereof.

What is claimed is:

1. A baby walker, comprising:

1.) a base, hollow in shape, having an upward extended adjustable link at each of its two laterals, and having a plurality of rollers at its bottom used for rolling against the ground;

2.) a hollow surround, having two regulators sustained by the top ends of the adjustable links, where the two regulators each has a sliding trough in the side that faces the other sliding trough, and one of two adjusting poles being placed with its two ends being joined to the like ends of the two sliding troughs respectively, where the distance between the two adjusting poles is adjustable; the two adjusting poles each supporting a connecting member, and a fixing member being extended from each of two ends of the connecting member, where the fixing members are used to encircle a riding infant child for holding his/her body; and 3.) the roller is a damping wheel, the damping wheel is provided with a cavity therein, where the cavity has an inner gear surface at its inner wall, and the cavity containing an arced flat member and an outer gear which has partial gear surfaces in mesh with the inner gear surface, where an axle of the outer gear extends through a crank to extend out through the center of the damping wheel; an outer protruded surface of the arced flat member corresponding to the inner gear surface and an inner indented surface of the arced flat member corresponds to the outer gear, and the cavity being infused with oil, the cavity provided with an inlet and an outlet at its two laterals facing each other, the inlet and the outlet are interconnected by a tube outside the cavity, and an oil regulating valve to control flow of the oil that flows into the tube, which is used to adjust the rotational speed of the damping wheel.

2. A baby walker as in claim 1 wherein each end of the fixing members features a sticky buckle, and the fixing members being selectively tied together by the sticky buckles.

3. A baby walker as in claim 1 wherein the regulator is wrapped by a sheath at its outer side.

4. A baby walker as in claim 1 wherein the regulator is provided with positioning members corresponding to each end portion of the adjusting pole, for immobilizing the adjusting pole after adjusting the distance between the two adjusting poles.

* * * * *